US008296899B2

(12) United States Patent
Veenstra

(10) Patent No.: US 8,296,899 B2
(45) Date of Patent: Oct. 30, 2012

(54) ROBOTIC VACUUM CLEANER COMPRISING A SENSING HANDLE

(75) Inventor: Auke-Jan Veenstra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/126,059

(22) PCT Filed: Oct. 26, 2009

(86) PCT No.: PCT/IB2009/054728

§ 371 (c)(1), (2), (4) Date: Apr. 26, 2011

(87) PCT Pub. No.: WO2010/061299

PCT Pub. Date: Jun. 3, 2010

(65) Prior Publication Data

US 2011/0203072 A1 Aug. 25, 2011

(30) Foreign Application Priority Data

Nov. 3, 2008 (EP) ..... 08168199

(51) Int. Cl.

| | |
|---|---|
| ***A47L 5/00*** | (2006.01) |
| ***A47L 9/28*** | (2006.01) |
| ***A47L 9/32*** | (2006.01) |

(52) U.S. Cl. ..... 15/325; 15/319; 15/339; 15/340.1; 15/410

(58) Field of Classification Search ..... 15/319, 15/325, 339, 340.1, 410; *A47L 5/00, 9/28, A47L 9/32*

See application file for complete search history.

(56) References Cited

U.S. PATENT DOCUMENTS

| | | | | |
|---|---|---|---|---|
| 5,341,540 | A * | 8/1994 | Soupert et al. | 15/319 |
| 6,766,556 | B2 | 7/2004 | Gergek | |
| 6,883,201 | B2 * | 4/2005 | Jones et al. | 15/319 |
| 7,571,511 | B2 * | 8/2009 | Jones et al. | 15/319 |
| 2002/0174506 | A1 | 11/2002 | Wallach et al. | |
| 2005/0055795 | A1 | 3/2005 | Zeiler et al. | |
| 2006/0137129 | A1 | 6/2006 | Schroter | |

FOREIGN PATENT DOCUMENTS

| | | | |
|---|---|---|---|
| WO | 0036970 | A1 | 6/2000 |
| WO | 2004058032 | A1 | 7/2004 |

* cited by examiner

*Primary Examiner* — David Redding

(57) ABSTRACT

A robotic vacuum cleaner comprising sensor means for detecting physical contact with stationary objects in the environment of the vacuum cleaner. The vacuum cleaner comprises a handle (1) for carrying the vacuum cleaner by hand (3). The handle (1) can be in a second position whereby the handle (1) is located close to the body (4) of the vacuum cleaner, whereby the sensor means detect forces exerted on the handle (1) during operation of the vacuum cleaner.

7 Claims, 2 Drawing Sheets

ROBOTIC VACUUM CLEANER COMPRISING A SENSING HANDLE

FIELD OF THE INVENTION

The invention is related to a robotic vacuum cleaner comprising sensor means for detecting physical contact with stationary objects in the environment of the vacuum cleaner.

BACKGROUND OF THE INVENTION

Such robotic vacuum cleaner is disclosed in US-A-2002/0174506. This publication describes an autonomous vacuum cleaner comprising technology that can automate routine household tasks eliminating the need for humans to perform these repetitive and time consuming tasks. The vacuum cleaner can autonomously clean a room while the vacuum cleaner is travelling around on the floor of the room. Thereby, the path of the vacuum cleaner can be controlled based on observations of its environment by cameras or other observation means, such as sonar sensors or infrared sensors. Additionally, sensor means are present at one or more sides of the mobile device in order to detect physical contact between the mobile device and stationary objects (obstacles) on the floor of the room. The sensor means generate appropriate control signals for controlling the path of travel of the vacuum cleaner. The vacuum cleaner described in US-A-2002/0174506 consists of two modules, a main module comprising the vacuum fan and a debris collection compartment, and a cleaning head module connected with the main module by a hose, through which hose the debris is transported from the cleaning head module to the main module.

The mobile robotic vacuum cleaner has to find its path of travelling around and between stationary objects in its environment. When the moving vacuum cleaner touches a stationary object, its direction of travelling has to be changed, so that collision with the stationary object is avoided. Therefore, physical contact with such stationary object is detected in order to adapt the direction of movement of the vacuum cleaner, for example in the opposite direction, away from the stationary object.

SUMMARY OF THE INVENTION

In general, it is desired that a vacuum cleaner can be carried by hand, for example in order to bring the vacuum cleaner to the room to be cleaned. Therefore, the vacuum cleaner can be provided with a hinging handle. Publication US-A-2006/0137129 describes a vacuum cleaner comprising a handle that can pivot between a first position whereby the handle is in a substantial upright position in order to carry the vacuum cleaner by hand, and a second position whereby the handle is located close to the body of the vacuum cleaner.

The object of the invention is a robotic vacuum cleaner that can be carried by hand, which vacuum cleaner comprises efficient sensor means for detecting physical contact with stationary objects in the environment when travelling around on the floor of the room to be cleaned.

In order to accomplish with that object, the vacuum cleaner comprises a handle for carrying the vacuum cleaner by hand, which handle can pivot between a first position whereby the handle is in a substantial upright position in order to carry the vacuum cleaner, and a second position whereby the handle is located close to the body of the vacuum cleaner, whereby said sensor means can detect forces exerted on the handle when the handle is in said second position. Thereby, the detected forces can be translated in appropriate control signals for controlling the path of travel of the vacuum cleaner.

In said second position, the handle reaches outside the body of the vacuum cleaner so that it can be shaped as a detection member around a part of the body for making physical contact with stationary objects when the vacuum cleaner is travelling around on the floor. Therefore, it is an appropriate means for sensing such physical contact.

The sensor means can be present on the surface of the handle, but in a preferred embodiment the sensor means can detect movements of the handle when the handle is in said second position. Thereby, the handle can be maintained by springs or other elastic means in said second position, whereby it can be moved a little against the force of said springs or other elastic means. Such movement is sensed by the sensor means and converted into an appropriate control signal for controlling the path of travel of the vacuum cleaner.

Preferably, the sensor means comprise micro switches for detecting movements of the handle when the handle is in said second position. More preferably, the micro switches are arranged at locations where different movements of the handle can be measured, so that appropriate control signals can be generated for different movements of the handle.

In a preferred embodiment, in top view of the vacuum cleaner at least a part of the handle extends outside the remainder portion of the vacuum cleaner. Most of the stationary objects in a room, such as tables, chairs, walls, doorframes etc., have near the floor vertical surfaces, so that a detection member extending beyond the side of the body of the vacuum cleaner (in top view) will touch such objects when the vacuum cleaner bumps against it.

In a preferred embodiment, in side view of the vacuum cleaner a part of the handle forms the highest part of the vacuum cleaner when the handle is in its second position. Thereby, the handle will be pushed downward in case the travelling vacuum cleaner arrives underneath a too low object, so that the presence and the location of such object is detected.

The invention is also related to a method for controlling the travelling path of a robotic vacuum cleaner, whereby a control signal is generated by sensor means when physical contact between the vacuum cleaner and a stationary object in the environment of the vacuum cleaner is detected by said sensor means, and whereby the vacuum cleaner comprises a handle for carrying the vacuum cleaner by hand, which handle can pivot between a first position whereby the handle is in a substantial upright position in order to carry the vacuum cleaner, and a second position whereby the handle is located close to the body of the vacuum cleaner, whereby said sensor means detect forces exerted on the handle when the handle is in said second position.

BRIEF DESCRIPTION OF THE DRAWING

The invention will now be further elucidated by means of a description of an embodiment of a robotic vacuum cleaner, whereby reference is made to the drawing comprising four figures, whereby.

DEATAILED DESCRIPTION OF AN EMBODIMENT

Figure 1:
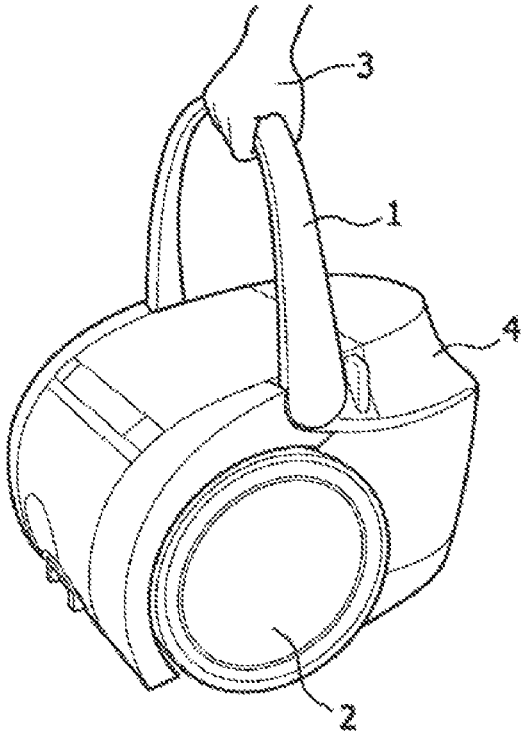
FIG. 1 shows the vacuum cleaner in the carrying position.
Figure 2:
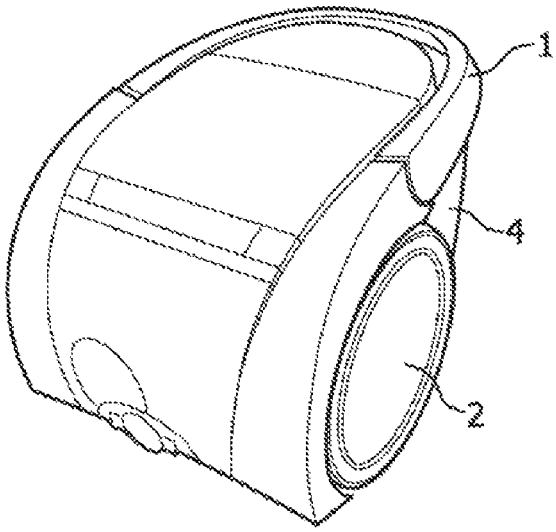
FIG. 2 is a perspective view of the vacuum cleaner.
Figure 3:
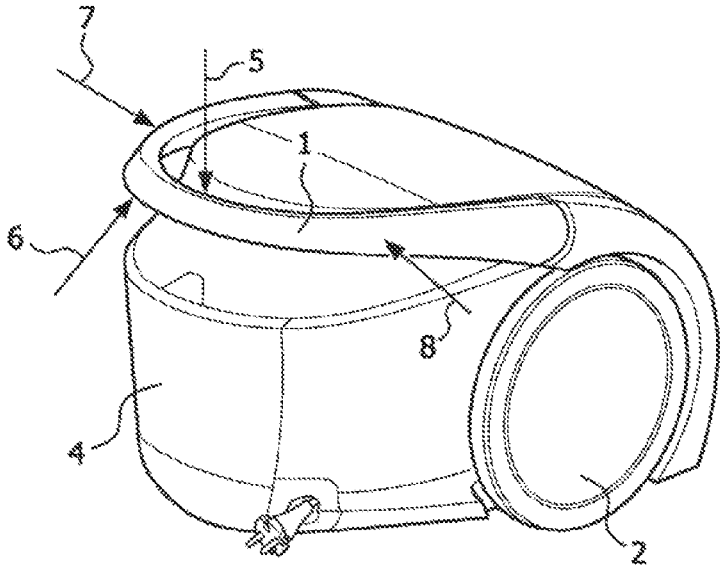
FIG. 3 shows another perspective view of the vacuum cleaner.

FIGS. 1-3 show an embodiment of a robotic vacuum cleaner comprising a hinging handle 1 for carrying the device.

The vacuum cleaner comprises two driven wheels 2 located at both sides of the device (the figures show only one of these wheels). Furthermore, it comprises a caster wheel that can rotate around a vertical axis so that the vacuum cleaner can move in any direction, which caster wheel is located at the lower side of the vacuum cleaner and is not visible in the figures. By driving the two wheels 2 independently with predetermined speeds, the vacuum cleaner can move over the floor of a room in any desired varying direction during its operation.

FIG. 1 shows the handle 1 in upright position, so that the vacuum cleaner can be carried by hand 3, as is shown in the figure. FIG. 2 shows the handle in its second position, being the position during operation of the robotic vacuum cleaner. FIG. 3 shows the vacuum cleaner from another direction. The handle 1 of the vacuum cleaner functions as a detection member during operation of the vacuum cleaner, whereby the handle is in its second position, as is shown in FIGS. 2 and 3. The handle 1 reaches outside the body 4 of the vacuum cleaner, so that the handle 1 can make physical contact with stationary objects in its environment when the vacuum cleaner is travelling around on the floor of the room to be cleaned.

The arrows 5,6,7,8 in FIG. 3 indicate the direction in which stationary objects can bump against the handle 1 when the vacuum cleaner is travelling around on the floor during its operation. When the vacuum cleaner is travelling under a too low table, the handle 1 will be pushed downward as is indicated by the arrow 5. The downward movement of the handle 1 will be detected by a micro switch, as will be elucidate hereinafter, whereby a control signal is generated in order to change the direction of travel of the device, for example the opposite direction. When the vacuum cleaner is travelling to the left (in FIG. 3), a collision with a stationary object will push the handle 1 in the direction indicated by the arrow 6. The movement of the handle 1 will be detected by one or more micro switches in order to generate an appropriate control signal for changing the direction of travel of the vacuum cleaner so that the stationary object can be avoided.

In particular when the vacuum cleaner is following a curved path, the handle 1 can be pushed sideward by a stationary object, as is indicated by the arrows 7 and 8. Such collision of the vacuum cleaner with a stationary object is also detected by micro switches measuring the movement of the handle 1, so that an appropriate control signal is generated for adaptation of the direction of travel of the device.

Figure 4:
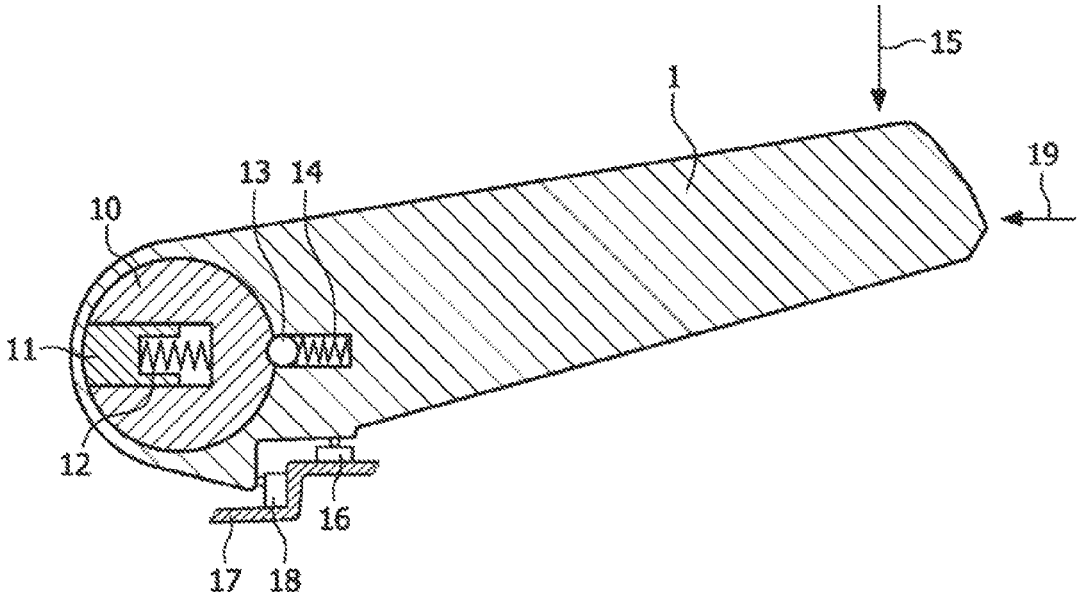
FIG. 4 is a diagrammatical sectional view of the sensor means.

FIG. 4 shows a schematic sectional view of the sensor means for detecting the movement of the handle 1. The handle 1 is mounted on a shaft 10 and can rotate around that shaft 10. Shaft 10 extends through the body 4 of the vacuum cleaner, whereby the two ends of shaft 10 reaches outside the body 4 of the vacuum cleaner. Each end of the handle 1 is connected to an end of the shaft 10, so that a firm connected between the handle 1 and the remainder part of the vacuum cleaner is achieved. The shaft 10 is connected with the body 4 of the vacuum cleaner through member 11, being a part of the body 4. The shaft 10 can move to the left (in FIG. 4) with respect to the member 11, but is pushed in the right direction by means of helical spring 12.

When the handle 1 is in its second position, as is shown in FIG. 4, the handle 1 is kept in that position by means of a spring loaded ball 13, which ball 13 cooperates with a corresponding recess in shaft 10. In said second position, helical spring 14 pushes ball 13 into that recess, and when the handle 1 moves a little away from said second position, helical spring 14 provides for a force to move the handle 1 back to the second position. When the handle 1 is in its upright position, as is shown in FIG. 1, the ball 13 rests against the cylindrical surface at the higher side of shaft 10.

When the robotic vacuum cleaner is in operation, the handle 1 functions as a detector for detecting physical contact, i.e. collision, with stationary objects in the environment of the moving vacuum cleaner. When there is no force exerted on the handle, the handle is kept in its second position by helical springs 12 and 14, which springs 12,14 are present near both ends of the shaft 10 and the handle 1. At the moment that a downward force is exerted on the handle 1, as is indicated by arrow 15 (in FIG. 3 by arrow 5), the handle 1 will rotate a little around the shaft 10 in clockwise direction, against the pushing force of helical spring 14. Such movement of the handle 1 is detected by micro switch 16, which micro switch 16 is attached to the housing 17 of the body 4 of the vacuum cleaner. When micro switch 16 is activated, a control signal for changing the direction of travel of the vacuum cleaner is generated.

In order to detect movements of the handle 1 in a substantial horizontal plane, as is indicated by arrow 19 (in FIG. 3 by arrows 6,7,8), a micro switch 18 is present at each end of the handle 1. Micro switch 18 is also attached to housing 17 of the body 4 of the vacuum cleaner and is actuated when the handle 1 is in its second position. A movement of handle 1 as is indicated with arrow 19 inactivates micro switch 18, whereby a control signal is generated to change the direction of travel of the robotic vacuum cleaner. In case only one of the two micro switches 18 at each end of handle 1 is detecting a movement of handle 1, then there is a sideward movement of handle 1, whereby an appropriate control signal can be generated.

While the invention has been illustrated in the drawing and the foregoing description, such illustration and description are to be considered illustrative or exemplary and not restrictive; the invention is not limited to the disclosed embodiment. Any reference signs in the claims should not be construed as limiting the scope of the invention.

The invention claimed is:

1. A robotic vacuum cleaner comprising sensor means for detecting physical contact with stationary objects in the environment of the vacuum cleaner, characterized in that the vacuum cleaner comprises a handle (1) for carrying the vacuum cleaner by hand (3), which handle (1) can pivot between a first position whereby the handle (1) is in a substantial upright position in order to carry the vacuum cleaner, and a second position whereby the handle (1) is located close to the body (4) of the vacuum cleaner, whereby said sensor means can detect forces exerted on the handle (1) when the handle (1) is in said second position.

2. A robotic vacuum cleaner as claimed in claim 1, characterized in that the sensor means can detect movements of the handle (1) when the handle (1) is in said second position.

3. A robotic vacuum cleaner as claimed in claim 2, characterized in that the sensor means comprise micro switches (16,18) for detecting movements of the handle (1).

4. A robotic vacuum cleaner as claimed in claim 3, characterized in that the micro switches (16,18) are arranged at locations where different movements of the handle (1) can be measured.

5. A robotic vacuum cleaner as claimed in claim 1, characterized in that in top view of the vacuum cleaner at least a part of the handle (1) extends outside the remainder portion (4) of the vacuum cleaner.

6. A robotic vacuum cleaner as claimed in claim 1, characterized in that in side view of the vacuum cleaner a part of the handle (1) forms the highest part of the vacuum cleaner when the handle (1) is in its second position.

7. A method for controlling the travelling path of a robotic vacuum cleaner, whereby a control signal is generated by sensor means when physical contact between the vacuum cleaner and a stationary object in the environment of the vacuum cleaner is detected by said sensor means, characterized in that the vacuum cleaner comprises a handle (1) for carrying the vacuum cleaner by hand (3), which handle (1) can pivot between a first position whereby the handle (1) is in a substantial upright position in order to carry the vacuum cleaner, and a second position whereby the handle (1) is located close to the body (4) of the vacuum cleaner, whereby said sensor means detect forces exerted on the handle (1) when the handle (1) is in said second position.

* * * * *